United States Patent [19]

Zehnder et al.

[11] 4,306,505

[45] Dec. 22, 1981

[54] GONDOLA CAR UNDERFRAME

[75] Inventors: Jürg Zehnder; Erich Neumeier, both of Zurich, Switzerland

[73] Assignee: Swiss Aluminium Ltd., Chippis, Switzerland

[21] Appl. No.: 60,350

[22] Filed: Jul. 25, 1979

[30] Foreign Application Priority Data

Feb. 23, 1979 [CH] Switzerland ..... 1795/79

[51] Int. Cl.[3] ..... B61D 3/00; B61D 17/08; B61D 17/10; B61F 1/00

[52] U.S. Cl. ..... 105/406 R; 105/409; 105/410; 105/411; 105/418; 105/422

[58] Field of Search ..... 105/378, 406 R, 422, 105/409, 410, 411, 416, 417, 418, 420, 423

[56] References Cited

U.S. PATENT DOCUMENTS

| | | | |
|---|---|---|---|
| 733,285 | 7/1903 | Shepard | 105/406 R |
| 743,497 | 11/1903 | Hansen | 105/406 R |
| 1,414,157 | 4/1922 | Russel | 105/410 |
| 1,579,673 | 4/1926 | Tench et al. | 105/409 X |
| 2,033,566 | 3/1936 | Wine | 105/406 R |
| 2,865,309 | 12/1958 | Lich | 105/406 R |
| 3,572,252 | 3/1971 | Coover et al. | 105/406 R |
| 3,587,477 | 6/1971 | Ferris | 105/378 |
| 3,774,553 | 11/1973 | Kunst et al. | 105/409 X |
| 3,776,144 | 12/1973 | Eislers | 105/406 R |
| 3,964,399 | 6/1976 | Miller et al. | 105/406 R |
| 4,016,691 | 4/1977 | Cale | 105/406 R |
| 4,082,045 | 4/1978 | McNally et al. | 105/406 R X |

*Primary Examiner*—Joseph F. Peters, Jr.
*Assistant Examiner*—Howard Beltran
*Attorney, Agent, or Firm*—Bachman and LaPointe

[57] ABSTRACT

Very high demands are made on gondola cars which are emptied on rotating/tilting unloading devices. Such cars must provide long service lives even under these very rough conditions, and they should allow simple loading and unloading via a rotating/tilting device. In accordance with the instant disclosure, the high strength of the gondola car body is maintained in a simple manner in that the flooring sheets of the body are set into grooves in the longitudinal center sill, and into a groove in each inside of the lower side sills, and then welded to the said sills. Also the walls of the car may be set in different ways, as by setting them into a groove in the upper side of the lower side sills and into a groove in the lower side of the upper side sill, and then welded to the said side sills.

14 Claims, 15 Drawing Figures

FIG. 6
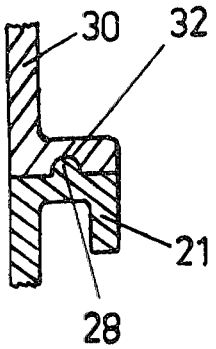
FIG. 7
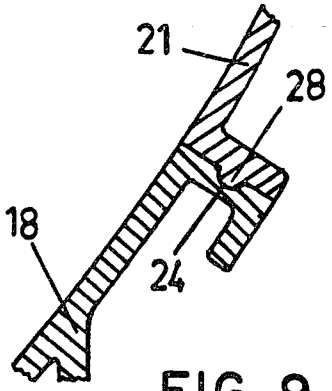
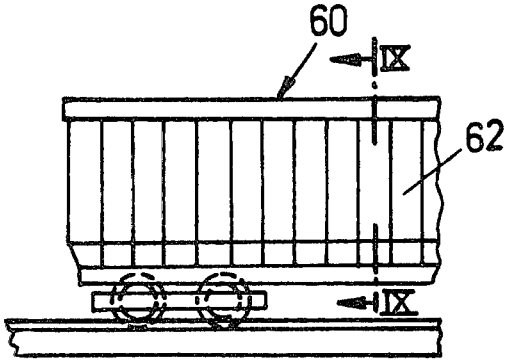
FIG. 8
FIG. 9
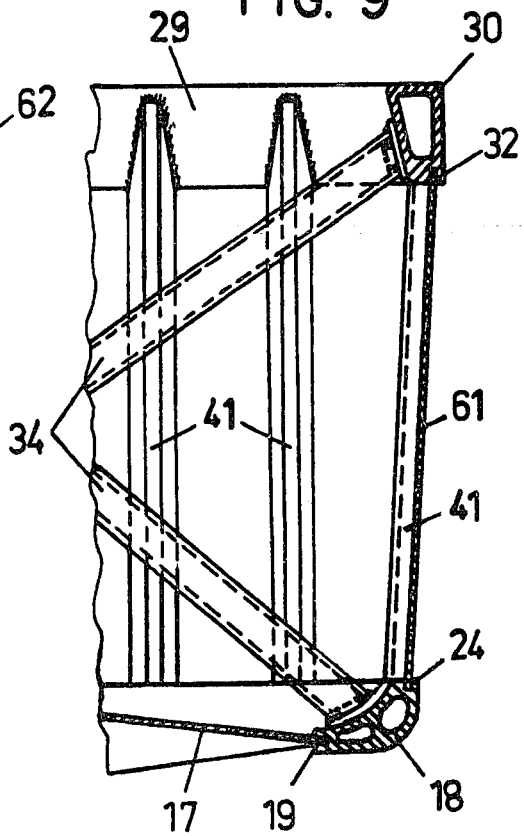

FIG. 10
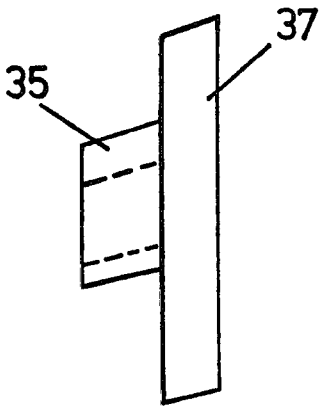
FIG. 11
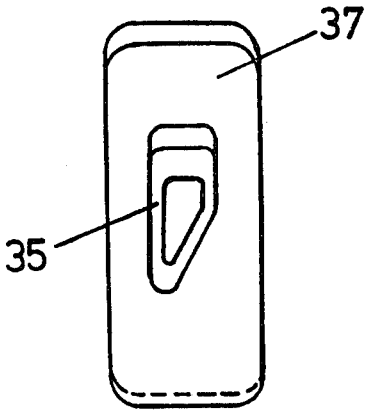
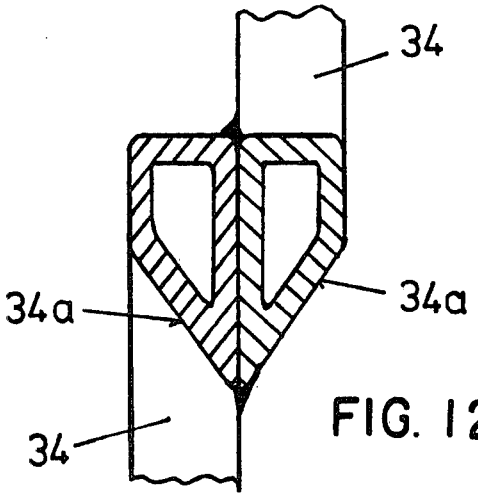
FIG. 12

GONDOLA CAR UNDERFRAME

BACKGROUND OF THE INVENTION

The present invention relates to a gondola car for unloading in a rotating/tilting facility, where the body of the car is provided with a central, full length sill as support. Two trucks or bogies which can turn are attached to the sill and at each end of the sill a buffer coupling is provided.

In order that such cars give trouble-free service, they usually have to be constructed with a relatively expensive, very rigid design which must be able to cope with very rough treatment. At the same time they should enable an easy filling and emptying via a rotating/tilting facility.

It has been found that such railway cars can be constructed with much reduced expenditure than was previously the case, and at the same time without impairing the rigidity or strength of such a car and the simplicity of loading and unloading.

The object of the present invention is therefore to develop a gondola car with which the above-mentioned disadvantages associated with the known cars of the previously mentioned kind are avoided.

SUMMARY OF THE INVENTION

This object is achieved by way of the present invention via the combination of the following features:

(a) The flooring sheets of the body of the car are set into grooves in a longitudinal center sill and into a groove in each inner side of the lower side sills, and are welded to the said longitudinal center sill and the lower side sills, and (b) the walls of the body of the car can be set in a groove in the upper side of the lower side sill and also in a groove in the lower side of the upper side sill of the body of the car and are welded to the said upper and lower sills. Other methods for setting the walls are also contemplated.

BRIEF DESCRIPTION OF THE DRAWINGS

Further details and advantageous exemplified embodiments of the invention are explained in the following description.

The drawings show in a simplified schematic form two exemplified embodiments of the invention viz.

FIG. 6: A view in cross section of an area B encircled by a broken line in FIG. 2, showing a point of connection between an upper sill and a sidewall, but shown here on a larger scale than in FIG. 2.

FIG. 7: A view in cross section of an area C encircled by a broken line in FIG. 2, showing a point of connection between a lower sill and a sidewall, but shown here on a larger scale than in FIG. 2.

FIG. 8: A part of a side view of a railway car corresponding to a second exemplified embodiment of the invention.

FIG. 9: A view showing part of the car in FIG. 8 sectioned along line IX—IX in FIG. 8.

FIG. 10: A side view of a forged or cast piece 35/37 which is fixed to the upper sill and has the form of a plug joined to a plate and which is welded to the upper sill.

FIG. 11: A front view of the forged or cast piece 35/37 shown in FIG. 10.

FIG. 12: A section along line XII—XII in FIG. 2 through two struts 34 which are joined with the cast pieces by welding.

DETAILED DESCRIPTION

Figure 1:
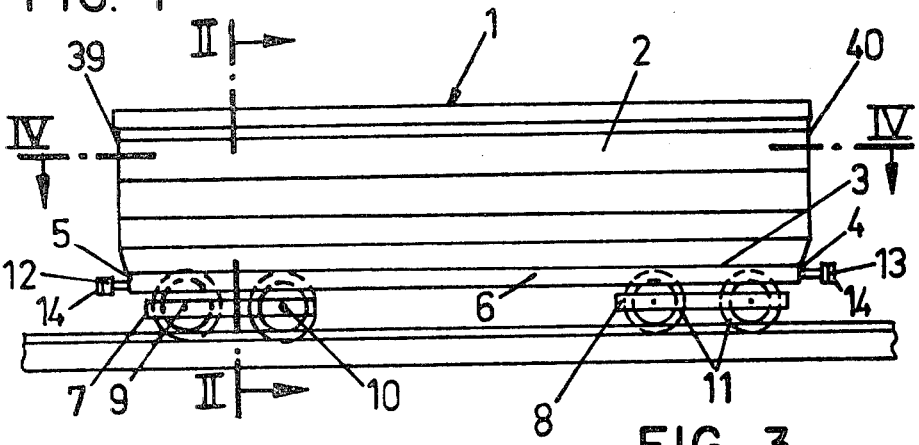
FIG. 1: A first exemplified embodiment of a railway car shown in a side view

The gondola car 1 in FIG. 1 representing the first exemplified embodiment of the invention features a high sidewalled car body 2 and floor 3 made of sheet supported on a center sill 6 which extends from a front end 4 to the rear end 5 of the floor 3. Trucks 7 and 8 which can turn in a horizontal plane are connected to the longitudinal center sill 6 in a conventional manner, which is however not illustrated here. Each of the trucks 7 and 8 is fitted with axles 9 and 10 which can rotate on bearings and are in turn fitted with permanently attached wheels 11. The center sill 6 features at each end a coupling 12 and 13 which is fitted with claws 14 which serve to connect the car releasably with an engine or another car not shown here. The center sill 6 features on both of its long sides two grooves 15 and 16 which extend the full length of the center sill 6, and which are provided for the purpose of inserting the floor 3 of the car in the same, and which is made out of sheet 17. After the flooring sheet 17 is inserted into the grooves 15 and 16, it is welded to the longitudinal center sill 6.

The flooring sheet 17 is domed upwards in the region where the trucks 7 and 8 turn. The upper flooring 17 is situated above said trucks and extends from groove 15 in the center sill 6 to groove 19 in the side sill 18. The lower flooring sheet 17 is inclined downwards in the region between the two trucks 7 and 8. The lower flooring 17 extends from the groove 16 in the center sill 6 to the groove 19 in the side sill 18.

The floor 3 of the car or the sheet 7 is attached all around to a side sill 18 which is in the form of a hollow section and which features on its inner side an undercut groove 19 for inserting the flooring sheet 17 in the same, where the flange 18 and flooring sheet 17 are joined by welding. On the upper side the side sill 18 features—in the region 20 where it butts on to the flat profiled section 21 of one of the sidewalls 22 and 23—a groove 24 which runs around the vehicle and into which a nose of flange of the sidewalls are set, as shown in FIG. 7, which provides a self-aligning relationship.

As shown in FIGS. 1, 2, 3 and 4, the sidewalls 22 and 23 comprise a plurality of the previously mentioned flat, preferably extruded, sections 21 which have reinforcing ribs 25 and which are joined together at both abutting regions 26 and 27 with the help of grooves and projections in the same way as the connection between an upper side sill 30 and the flat section 21 as in FIG. 6. When the sidewalls 22 or 23 made up of the flat sections 21 are in the assembled form, the grooves and projections are aligned with each other and engage in each other. This then endows the abutted, welded sections with particularly high strength to withstand the bending forces to which the sidewalls are subjected when in service.

Upper side sills 29 and 30 run completely round the upper opening 31 of the car body 2. The side sill 30 is connected to the upper flat section 21 of the sidewalls 22 and 23, as shown in FIG. 6. In the lower side of the upper side sills 29 and 30 there is a groove 32 into which a projection 28 in the flat section 21 engages when the gondola car is assembled.

With respect to the grooves and projections on the abutting edges of the flat sections 21, the projections 24 on the flat sections 21 and the grooves 32 on the lower side sill 18 and upper side sill 30, it should be mentioned in particular that the mating of these features simplifies the alignment of the individual flat sections 21 and the alignment of the lower side sills 18 and the upper side sills 30 with the relevant flat section 21, and does so in such a manner that much less expenditure is required for jigging facilities than is normally necessary for the assembly of railway cars.

On the inner side the sidewalls 22 and 23 are provided with essentially vertical U-shaped reinforcing elements 33 which are preferably spaced equally on the sidewalls 22 and 23 and welded to the lower side sills 18, the flat sections 21 and the upper side sill 30. The body 2 of the car is also provided with tubular struts 34 which run diagonally from the lower side sill 18 on one side to the upper side sill 30 on the other side and are held to these side sills 18 and 30 by means of castings or forgings which are welded to the said sills and fitted with projecting pins 35 and 36, and by these the struts are prevented from shearing off from the upper and lower side sills 18 and 30. The projections 35 and 36 form, together with plates 37 and 38 repsectively, units which are preferably cast of forged.

As shown in FIGS. 2, 3, 4 and 5 the end walls 39 and 40 comprise individual extruded sections 41 which are provided at one end with a component 42 or 43 of a snap fit connection 44 by means of which, and a weld seam 54, the sections 41 are joined together.

Figure 5:
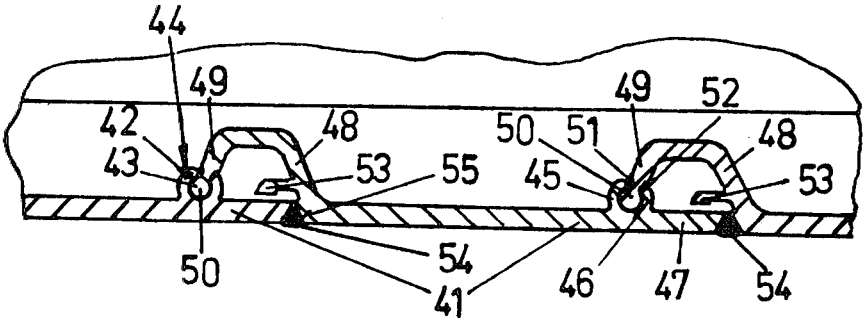
FIG. 5: A view of an area A of a wall encircled with a broken line in FIG. 4, but shown here on a larger scale than in FIG. 4.

As FIG. 5 shows, at one end of each section 14—as viewed in cross section—there are two claw-like projections 45 and 46 which extend the length of the section 41 and form one component 42 of the above-mentioned snap-fit connection 44. A further, relatively short length 47 of the section 41 extends beyond the projection 45. The other end of the section 41 features a U-shaped part 48 with a strut 49 which—as viewed in cross section—features a rounded edge 50 at the end with a rill or channel 51 and 52 on each side, which forms the other component 43 of the snap-fit connection 44. The U-shaped part 48 also features a projection 53 which helps the alignment of the individual sections 41 joined by the snap-fit connection 44 when making a weld 54 between one end of the part 47 and an inclined surface 55 provided on the U-shaped part 48. As can be seen from FIG. 9, the upper end of the extruded sections 41 are inserted into the grooves 32 in the upper sill 30 and welded to the said upper sill. The upper sill 29 and the end walls 39 and 40 are joined or welded, in a manner not shown in detail in FIG. 4, to reinforcing sheets 56 and 57 which are in turn joined to sidewalls 22 and 23 and to the upper side sills 30. Further, the lower ends of the individual sections 21 of end walls 39 and 40 are inserted in the groove 24 in the lower sill 18 in a manner not illustrated here and welded to the same. The sections of the end walls 39 and 40 can, as required, be arranged vertical or horizontal.

Figure 2:
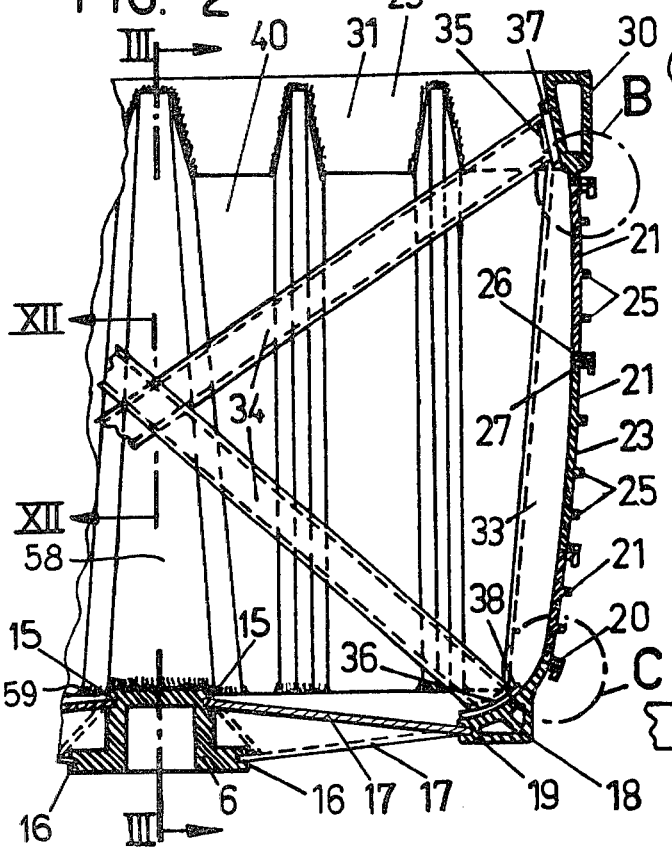
FIG. 2: A part of a cross section through the car shown in FIG. 1, sectioned along line II—II and shown in a larger scale than in FIG. 1.
Figure 3:
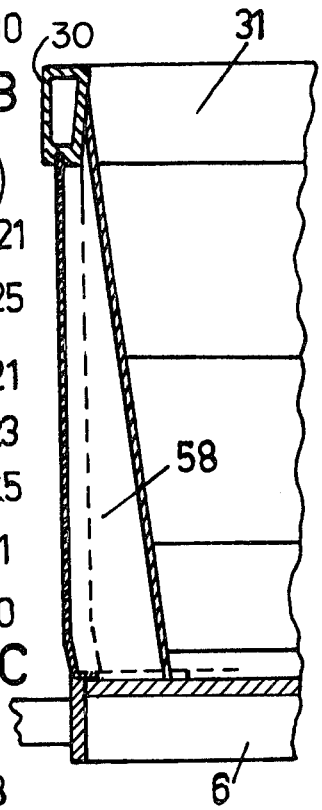
FIG. 3: A part of a vertical section through the car, as sectioned along line III—III in FIG. 2.
Figure 4:
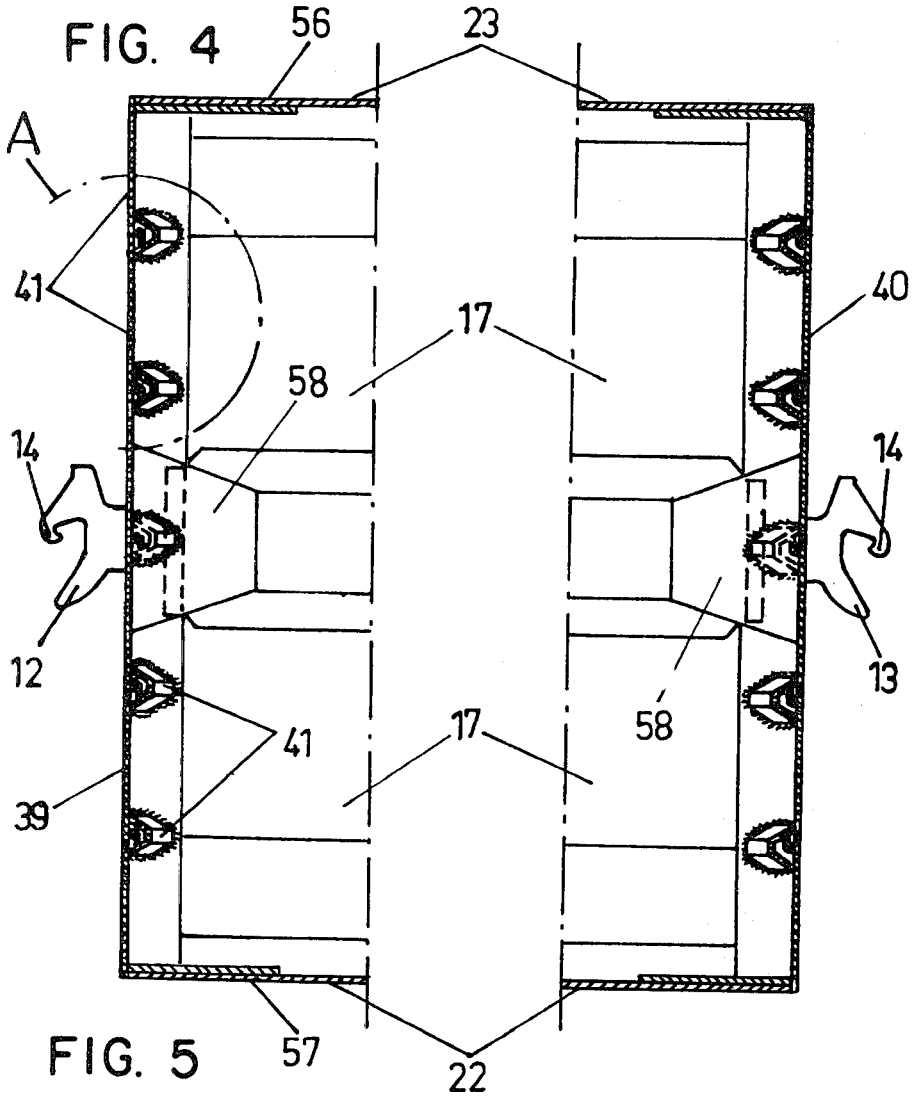
FIG. 4: A part of a horizontal longitudinal section through the car along line IV—IV in FIG. 1, but on a larger scale than in FIG. 1.

On the inside of each end wall 39 and 40 additional stiffening is provided by means of a column 58 which is U-shaped, tapers inwards towards the top and, as shown in FIG. 2, is anchored at position 59 to the center sill 6.

In the case of the second exemplified embodiment of a railway gondola car 60 shown in FIGS. 8 and 9 the sidewalls 61 and 62—in contrast to the sidewalls 22 and 23 of the first example–comprise individual sections 41 which are joined together and which can also be used in the end walls 39 and 40 of the car described in the first exemplified embodiment.

The connection of the individual sections 41 to the upper side sill 30 and the lower side sill 18 is made in the same manner as with the end walls 39 and 40 of the car in the first exemplified embodiment. Also the arrangement of the tubular struts 34 running diagonally from the lower side sill 18 on one side to the upper side sill 30 on the other side and the fixing to these sills is the same as in the first example. The floor of the car is also constructed in the same way as shown in the first example.

FIGS. 10 and 11 show a shoe in the form of a casting or forging 35/37 which is joined, by means of a weld not shown here, to an upper sill 30 running in lengthwise. The projection 35 has a trapezium-shaped outline which matches the tubular strut 34 into which it fits. The castings or forgings 36/38 welded to the lower sill 18 are similar to the castings or forgings 35/37 joined to the upper flange; further description of this component 36/38 on the lower sill 18 will therefore be omitted. Therefore, the cast or forged parts comprise a trapezium-shaped projection 35 or 36 and a plate 37 or 38 integral therewith.

As shown in FIG. 12, the diagonal struts 34 are each provided with an inclined surface **34*a* which points in the direction of the floor of the truck. The struts 34** are welded together where they cross over, resulting in particularly high rigidity in the car body.

The above-mentioned arrangement of the struts 34 and the inclined faces **34*a* have the result that on emptying the car the contents are displaced sideways by the inclined faces 34*a***—*a* feature which assists the emptying of the car.

Figure 13:
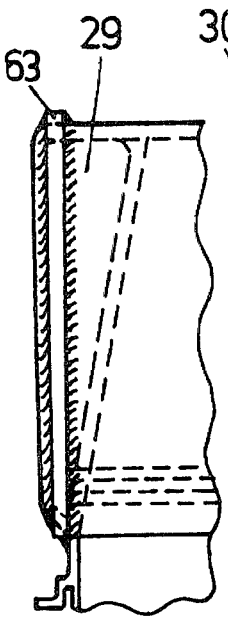
FIG. 13: A junction between a transverse upper sill and a longitudinal upper sill.
Figure 14:
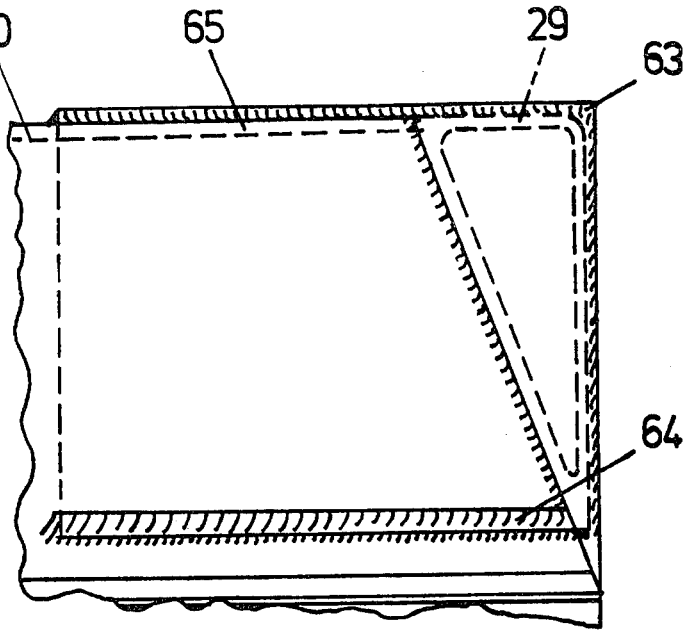
FIG. 14: A front view of the connection shown in FIG. 13.
Figure 15:
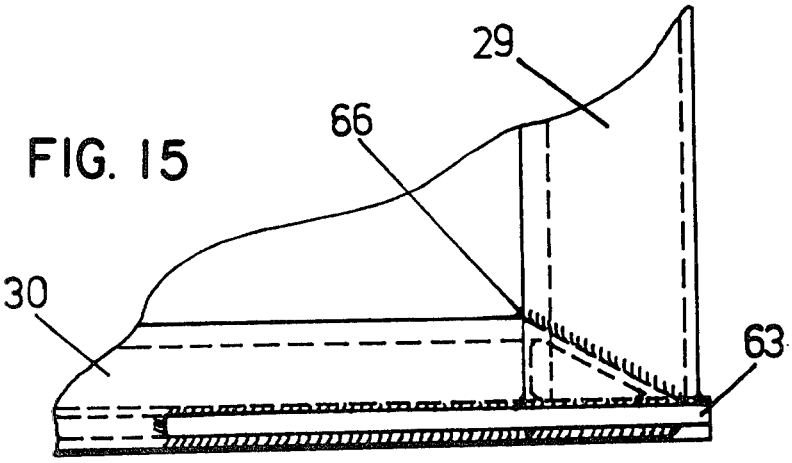
FIG. 15: A plan view of the junction shown in FIG. 13.

As shown in FIGS. 13, 14 and 15, the connection between the transverse upper sill 29 and the lengthwise running upper sill 30 is reinforced by a rectangular shaped plate 63 which is set in the recesses 64 and 65 in the ends of the upper sill 30 and welded to the sills 30 and 29. Both upper sills 29 and 30 are additionally welded together at a junction 66 in the inside.

The described connection of the transverse and lengthwise running upper sills 29 and 30 is very strong and particularly suitable for the rough conditions of service to which railway cars of this kind are subjected.

The invention is not limited to the exemplified embodiments described. It is within the scope of the invention for example to provide strengthening in the form of ribs or struts on the walls and floor of the car without diverging from the actual invention. Instead of the sections 21 or 41, it is also possible to use, for the sidewalls of the car, simple sheets which are fitted into the grooves 24 and 32 in the upper and lower flanges and welded into place, if this is desired.

The gondola car of the invention is intended mainly for unloading particulate materials by means of a rotating/tilting device or a rotary type dump, and has—in comparison with the known railway cars of the kind described earlier—numerous advantages which are related essentially to the relatively straightforward improvement in the most highly stressed connections, to the little need for repair and to the length of service life.

It is to be understood that the invention is not limited to the illustrations described and shown herein, which are deemed to be merely illustrative of the best modes of carrying out the invention, and which are suceptible of modification of form, size, arrangement of parts and details of operation. The invention rather is intended to encompass all such modifications which are within its spirit and scope as defined by claims.

What is claimed is:

1. A high strength gondola car comprising a car body, a grooved longitudinal center sill reinforcing said car body, two trucks pivotally mounted on said longitudinal center sill, a buffer coupling at each end of said car, grooved lower side sills spaced from the center sill, car body flooring sheets set into said grooves in the longitudinal center sill and into said grooves in an inner side of the lower side sills and welded to the said center sill and the side sills, and said car including car body walls and upper side sills having grooves in the lower side thereof, wherein the car body walls are set into the grooves in the lower side sills and into the grooves in the lower side of the upper side sill, and welded to said upper and lower side sills.

2. A gondola car according to claim 1 wherein a longitudinal upper end sill is provided joined to said upper side sill which runs transverse with respect thereto, and wherein to strengthen the joint between the longitudinal upper side sill and the transverse upper end sill, a rectangular shaped plate is inserted into recesses in said upper sill and welded to both of the said upper sills.

3. A gondola car according to claim 1 wherein said car body walls comprise a plurality of longitudinal extrusions joined to each other and to said side sills in self-aligning relationship.

4. A gondola car according to claim 1 wherein said car has end walls and wherein a U-shaped column is welded to the end walls and anchored and welded to the center sill to make the end walls more rigid.

5. A gondola car according to claim 4 wherein the U-shaped column tapers inwards towards the top.

6. A gondola car according to claim 1 wherein shoes are designed to accommodate struts and are permanently connected to the longitudinal upper side sill and the longitudinal lower side sill.

7. A gondola car according to claim 6 wherein the shoes comprise a trapezium-shaped projection and a plate.

8. A gondola car according to claim 7 wherein said struts are tubular in form and have a hollow interior corresponding to the trapezium-shape of the projections.

9. A gondola car according to claim 6 wherein the struts are affixed to the shoes with an inclined face pointing towards the floor of the car.

10. A gondola car according to claim 9 wherein at least one of said struts run from the upper side sill across the interior of the car to the lower side sill.

11. A gondola car according to claim 10 wherein two struts are provided which run diagonally with respect to each other.

12. A gondola car according to claim 11 wherein the diagonal struts are welded together where they cross over.

13. A gondola car according to claim 1 wherein the walls of the car body are extruded sections which are provided at one end with one component of a snap-fit connection and which are joined permanently together by means of this connection and a weld seam.

14. A gondola car according to claim 13 wherein the extruded sections of the walls are arranged to run horizontally.

* * * * *